US012157958B1

(12) United States Patent
Ilyas

(10) Patent No.: US 12,157,958 B1
(45) Date of Patent: Dec. 3, 2024

(54) ULTRAVIOLET PROTECTING FABRIC AND METHOD OF PREPARATION THEREOF

(71) Applicant: AmberNoon, LLC, Wayne, PA (US)

(72) Inventor: Erum N. Ilyas, Wayne, PA (US)

(73) Assignee: AmberNoon, LLC, Wayne, PA (US)

( * ) Notice: Subject to any disclaimer, the term of this patent is extended or adjusted under 35 U.S.C. 154(b) by 99 days.

(21) Appl. No.: 17/668,218

(22) Filed: Feb. 9, 2022

(51) Int. Cl.
*D02G 3/04* (2006.01)
*D02G 3/32* (2006.01)
*D02G 3/44* (2006.01)

(52) U.S. Cl.
CPC ..... *D02G 3/045* (2013.01); *D02G 3/328* (2013.01); *D02G 3/44* (2013.01); *D10B 2331/04* (2013.01); *D10B 2401/22* (2013.01)

(58) Field of Classification Search
CPC ..... D02G 3/045; D02G 3/04; D02G 3/02; D02G 3/00; D02G 3/328; D02G 3/32; D02G 3/22; D02G 3/44; D10B 2332/04; D10B 2401/22
See application file for complete search history.

(56) References Cited

U.S. PATENT DOCUMENTS 5,637,348 A 6/1997 Thompson et al.
6,015,504 A 1/2000 Reinehr et al.
6,289,524 B1 * 9/2001 Wright ..... A41D 13/015 2/457
6,610,214 B2 8/2003 Goldenhersh et al.
6,641,920 B2 11/2003 Conn et al.
7,262,160 B2 8/2007 Black
8,137,957 B2 3/2012 Wenstrup et al.
10,494,528 B2 12/2019 Kramer et al.
10,577,503 B2 3/2020 Kramer et al.
10,752,741 B2 8/2020 Heiskanen et al.
10,765,160 B2 9/2020 Page
10,774,448 B2 9/2020 Yang
2008/0134444 A1 * 6/2008 Greenspoon ..... D06B 21/00 8/115.56
2015/0020546 A1 * 1/2015 Zhang ..... D04B 21/18 28/155
2015/0159304 A1 * 6/2015 Schmitt ..... D02G 3/443 428/221
2018/0279692 A1 * 10/2018 Witek ..... A41C 3/0057
2020/0060367 A1 * 2/2020 Gonzalez De Los Santo ..... D03D 15/37
2020/0385901 A1 * 12/2020 Lawrence ..... D04B 21/18
2021/0047757 A1 * 2/2021 Cleveland ..... A41D 17/02
2021/0246582 A1 * 8/2021 Lau ..... D03D 15/225
(Continued)

OTHER PUBLICATIONS

Senthilkumar, M., et al., "Elastane fabrics—a tool for stretch applications in sports," Indian Journal of Fibre & Textile Research, vol. 36, Sep. 2011, pp. 300-307.
(Continued)

*Primary Examiner* — Khoa D Huynh
*Assistant Examiner* — Uyen T Nguyen
(74) *Attorney, Agent, or Firm* — Rahman LLC

(57) ABSTRACT

An improved ultraviolet (UV) blocking fabric that has an ultraviolet protection factor (UPF) rating of at least 49 in accordance with AATCC 183. The fabric does not require ultraviolet protecting coating(s) or finish(es) or such other treatment for achieving the desired ultraviolet protecting efficiency. Further, the fabric affords maintenance of the UPF rating even after the fabric has been subjected to several laundering cycles.

19 Claims, 10 Drawing Sheets

(56) References Cited

U.S. PATENT DOCUMENTS

| | | | | |
|---|---|---|---|---|
| 2022/0258450 | A1* | 8/2022 | Lawrence | D01F 6/92 |
| 2022/0275576 | A1* | 9/2022 | Liu | D03D 15/56 |
| 2022/0411975 | A1* | 12/2022 | Hanamura | D04B 1/18 |

OTHER PUBLICATIONS

Sarioglu, E., et al., "A Study on Physical Properties of Microfilament Composite Yarns," Journal of Engineered Fibers and Fabrics, vol. 11, Issue 3, Sep. 2016, pp. 90-98.

* cited by examiner

10

10

10

ULTRAVIOLET PROTECTING FABRIC AND METHOD OF PREPARATION THEREOF

BACKGROUND

Technical Field

The embodiments herein generally relate to textiles, and more particularly to an improved ultraviolet (UV) blocking fabric that has an ultraviolet protection factor (UPF) rating of at least 49 in accordance with AATCC 183, provides for a comfortable feel for a wearer, and has enhanced strength characteristics.

Description of the Related Art

UV radiation is a form of electromagnetic radiation that comes from the sun and some man-made sources. UV rays are in the middle of the radiation spectrum and are classified into different types such as UVA, UVB, and UVC, depending upon the amount of energy they possess. UVA rays have the least energy among UV rays and may cause skin cells to age with some indirect damage to deoxyribonucleic acid (DNA). UVA rays are mainly linked to long-term skin damage such as wrinkles and skin cancers. UVB rays have slightly more energy than UVA rays and can damage the DNA directly and are the main rays that cause sunburns. UVC rays have more energy than the other types of UV rays and are the most damaging among UV rays. However, these rays are absorbed by the ozone layer and generally pose no threat to humans. Moreover, some man-made UV sources such as arc mercury lamps, UV sanitizing bulbs (to kill germs), and welding torches acts as indirect sources of UVC rays.

Clothing made from different woven fabrics may provide personal protection against such UV rays (specifically, UVA and UVB rays), but not all fabrics or colors of fabric may provide equal protection. Different fabrics differ in their ability to attenuate UV light in ways as they differ in fabric materials/composition, fabric weaving pattern, construction, properties, and some fabric surface modifications.

Multiple approaches have been tried to prepare fabrics that may provide good UV protection to the human skin. One of most widely used conventional approaches is to coat the surface of fabric with some type of chemical compound that acts as a UV blocker and prevents the exposure of human skin to such high energy radiation. However, such chemical finishes may have a negative bearing on human health and the environment, and hence, are less preferred.

There is, therefore, an unmet need in the industry for a new and improved UV protecting fabric that may provide significant and long-term UV protection to the human skin without negatively affecting human health and the environment, and which results in a comfortable fabric for a wearer.

SUMMARY

In view of the foregoing, an embodiment herein provides an ultraviolet blocking fabric to be worn by a user. The fabric comprises a warp yarn; a weft yarn; and a material composition of 89% polyester and 11% spandex, wherein at least one of the warp yarn and the weft yarn being an elastane yarn, wherein a combination of the warp yarn and the weft yarn arranged to form the fabric comprises an ultraviolet protection factor (UPF) rating of at least 49 in accordance with AATCC 183, and wherein the UPF rating is achieved without applying conventional laundry additives to the fabric.

At least one of the warp yarn and the weft yarn may be selected from a synthetic yarn and a semi-synthetic yarn. The synthetic yarn may comprise a polyester yarn.

The polyester yarn may comprise a recycled polyester yarn. The polyester yarn may comprise a polyethylene terephthalate (PET) yarn. The semi-synthetic yarn may comprise rayon. The semi-synthetic yarn may comprise lyocell. The synthetic yarn may comprise 30d spandex at 128"×1 rev (3.7 cms on 30 needles). The elastane yarn may comprise a denier ranging from 15d to 60d.

The fabric may have a cover factor ranging from 60% to 85% after 40 laundering cycles in accordance with AATCC 135 2018. The fabric may have UPF rating of at least 50 in accordance with AATCC 183. The UPF rating may be determined in accordance with AATCC 183-2010 after 40 laundering cycles and further in accordance with AATCC 135 2018. The fabric may be devoid of bleached chemical thermo mechanical pulp, textile fleece, activated carbon, magnesium stearate, a disintegrant, or zinc oxide. The fabric may be devoid of titanium finishes or coatings.

The fabric may comprise an UPF rating of at least 35 in accordance with ASTM D6603. The fabric may be configured to cover a user's body except the face. The fabric may further comprise a bleaching agent. A process is provided for forming the fabric comprising forming the fabric with a 28-gauge knitting machine. The process may comprise adding a fabric dye and textile softener to the fabric. The process may comprise heating the fabric.

These and other aspects of the embodiments herein will be better appreciated and understood when considered in conjunction with the following description and the accompanying drawings. It should be understood, however, that the following descriptions, while indicating exemplary embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
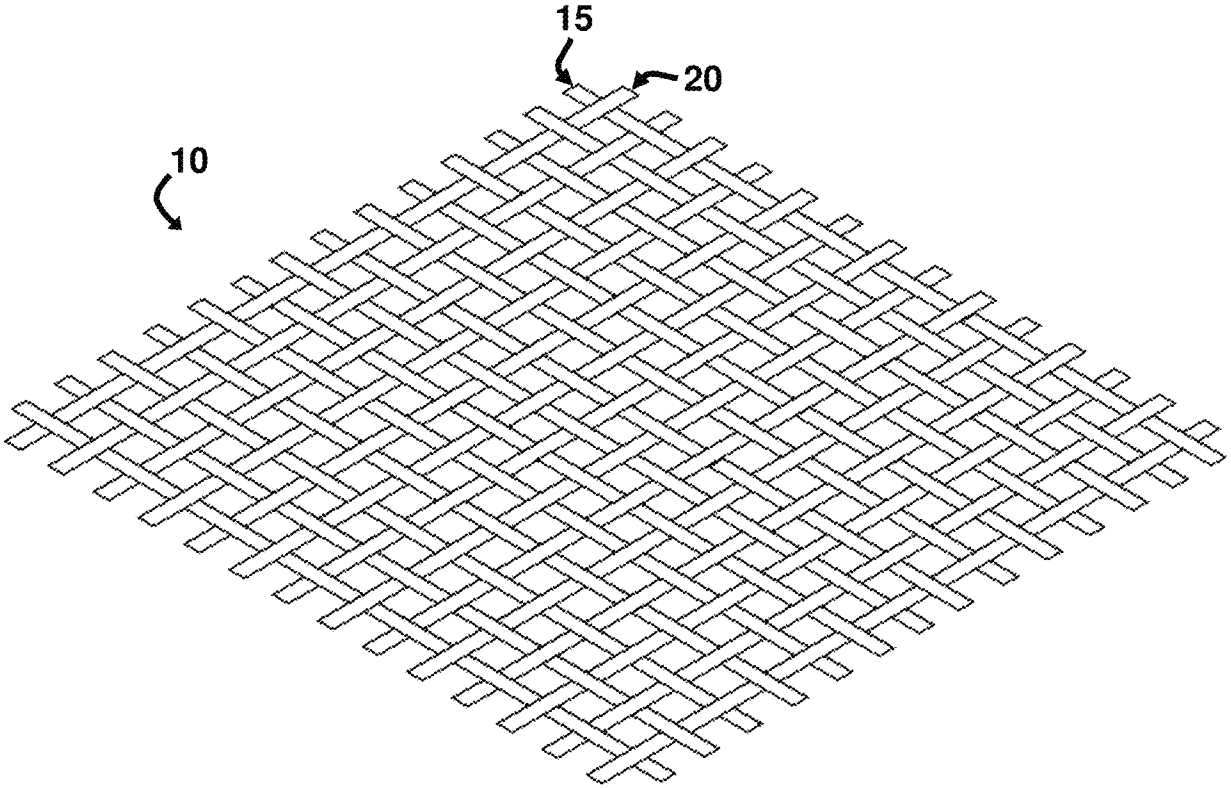
FIG. 1A is a schematic diagram illustrating a UV-protective fabric in a cross knit configuration, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

Unless the context requires otherwise, throughout the specification, drawings, and/or claims which follow, the word "comprise" and variations thereof, such as, "comprises" and "comprising" are to be construed in an open, inclusive sense that is as "including, but not limited to."

Reference throughout this specification to "one embodiment" or "an embodiment" or "an example" means that a particular feature, structure, or characteristic described in connection with the embodiment or example is included in at least one embodiment or example. Thus, the appearances of the phrases "in one embodiment" or "in an embodiment" or "in an example" in various places throughout this specification are not necessarily all referring to the same embodiment or example. Furthermore, the particular features, structures, or characteristics may be combined in any suitable manner in one or more embodiments or examples.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

In some embodiments and examples, the numbers expressing quantities of ingredients, properties such as concentration, and so forth, used to describe and claim certain embodiments herein are to be understood as being modified in some instances by the term "about" or "approximately". Accordingly, in some embodiments, the numerical parameters set forth in the written description are approximations that can vary depending upon the desired properties sought to be obtained by a particular embodiment, unless otherwise indicated. In some embodiments, the numerical parameters should be construed in light of the number of reported significant digits and by applying ordinary rounding techniques. Notwithstanding that the numerical ranges and parameters setting forth the broad scope of some embodiments herein are approximations, the numerical values set forth in the specific examples are reported as precisely as practicable.

Furthermore, the recitation of ranges of values herein is merely intended to serve as a shorthand method of referring individually to each separate value falling within the range. Moreover, unless otherwise indicated herein, each individual value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the descriptions herein and does not pose a limitation on the scope of the embodiments herein otherwise claimed. No language in the specification should be construed as indicating any non-claimed element essential to the practice of the embodiments herein.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Various terms as used herein are shown below. To the extent a term used in a claim is not defined below, it should be given the broadest definition persons in the pertinent art and/or industry have given that term as reflected in printed publications and issued patents and/or known to those skilled in the art at the time of filing herein.

The term "ultraviolet protecting coating" as used denotes any physical or chemical coating or finishing or otherwise any other treatment of the fabric with an aim of improving its ultraviolet protecting efficiency. For example, one or more titanium finishes may be applied in a conventional fabric to improve its ultraviolet protecting efficiency. However, the advantageous fabric of the embodiments herein does not require any such coating or finishing to achieve the stated ultraviolet protection factor (UPF).

The term "cover factor" as used relates to the geometry of the weave and denotes the percentage of the gross surface area of the fabric that is covered by yarns of the fabric. If the weave or knit is closer together with less space between the yarns, then less UV can be transmitted through the fabric, and higher will be the cover factor. For example, a loosely woven fabric may potentially have 70% of a given area of textile covered by yarn and 30% open space left by the looseness of the weave. The cover factor may serve as an indication of how much unfiltered UV can reach the skin of the wearer.

Referring now to the drawings, and more particularly to FIGS. 1A through 3F, where similar reference characters denote corresponding features consistently throughout the figures, there are shown preferred embodiments. In the drawings, the size and relative sizes of components, layers, and regions, etc. may be exaggerated for clarity. For ease of understanding, components of the fabric that fall outside of the claimed invention are not shown so as to not unnecessarily obscure the drawings. However, those aspects of the claimed invention which are necessary to practice the invention are intended to be included in the specification and drawings in order to ensure full enablement of the drawings and as would be understood by one of ordinary skill in the art without the requirement of undue and/or excessive experimentation.

FIGS. 1A through 3C illustrate example embodiments herein providing an ultraviolet blocking fabric 10 to be worn by a user. For example, the fabric 10 may be configured to cover a user's body except the face. The fabric 10 may be patterned into a garment for the user. Examples of garments include shirts, pants, shorts, swimwear, athletic wear, and head coverings and hats that do not cover the user's face. Another example of the type of garment that may be constructed from the fabric 10 includes a mask to cover the user's mouth and nose only but no other parts of the user's face. Additionally, the fabric 10 may comprise any suitable color, shape, size, configuration, or pattern.

Figure 1B:
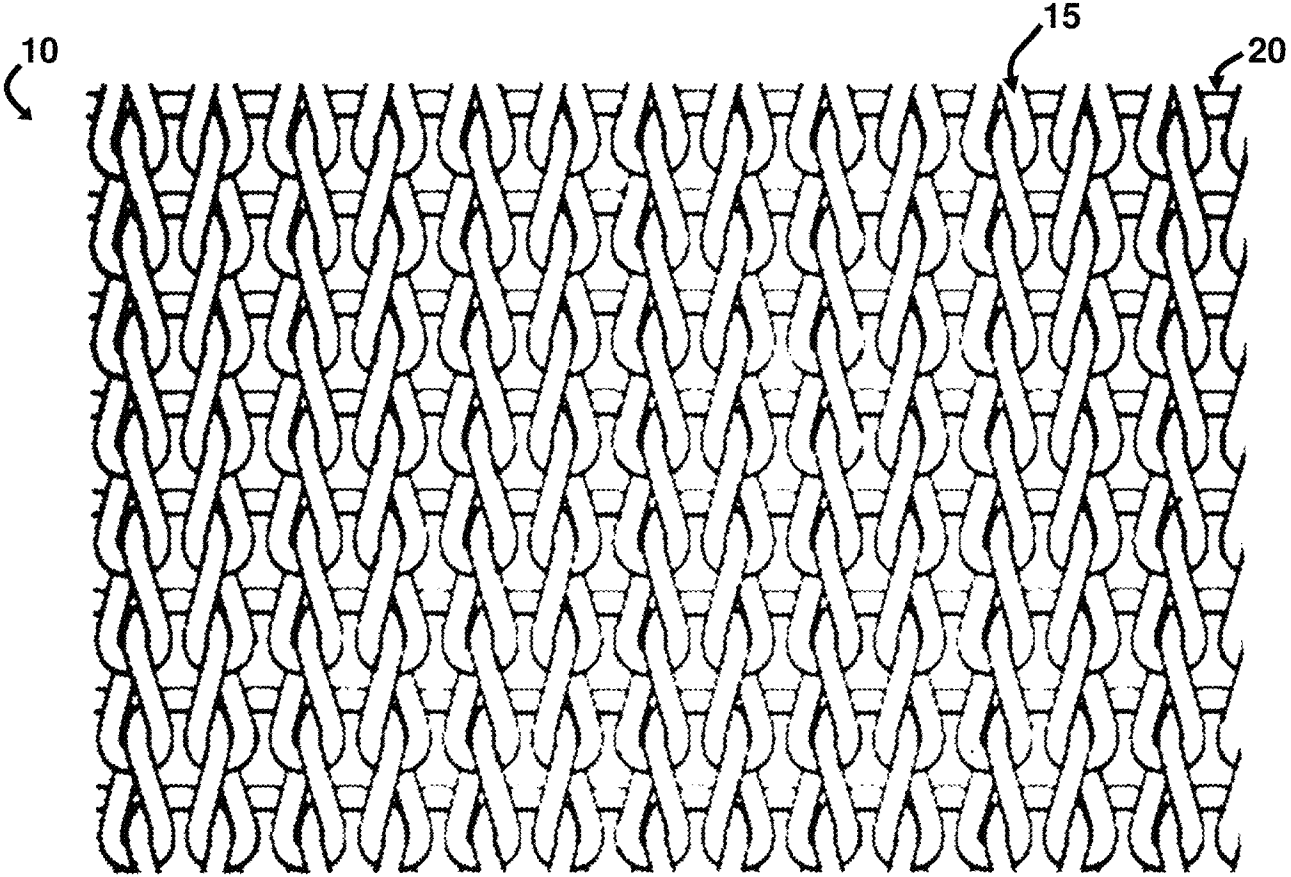
FIG. 1B is a schematic diagram illustrating a UV-protective fabric in a double knit configuration, according to an embodiment herein.
Figure 1C:
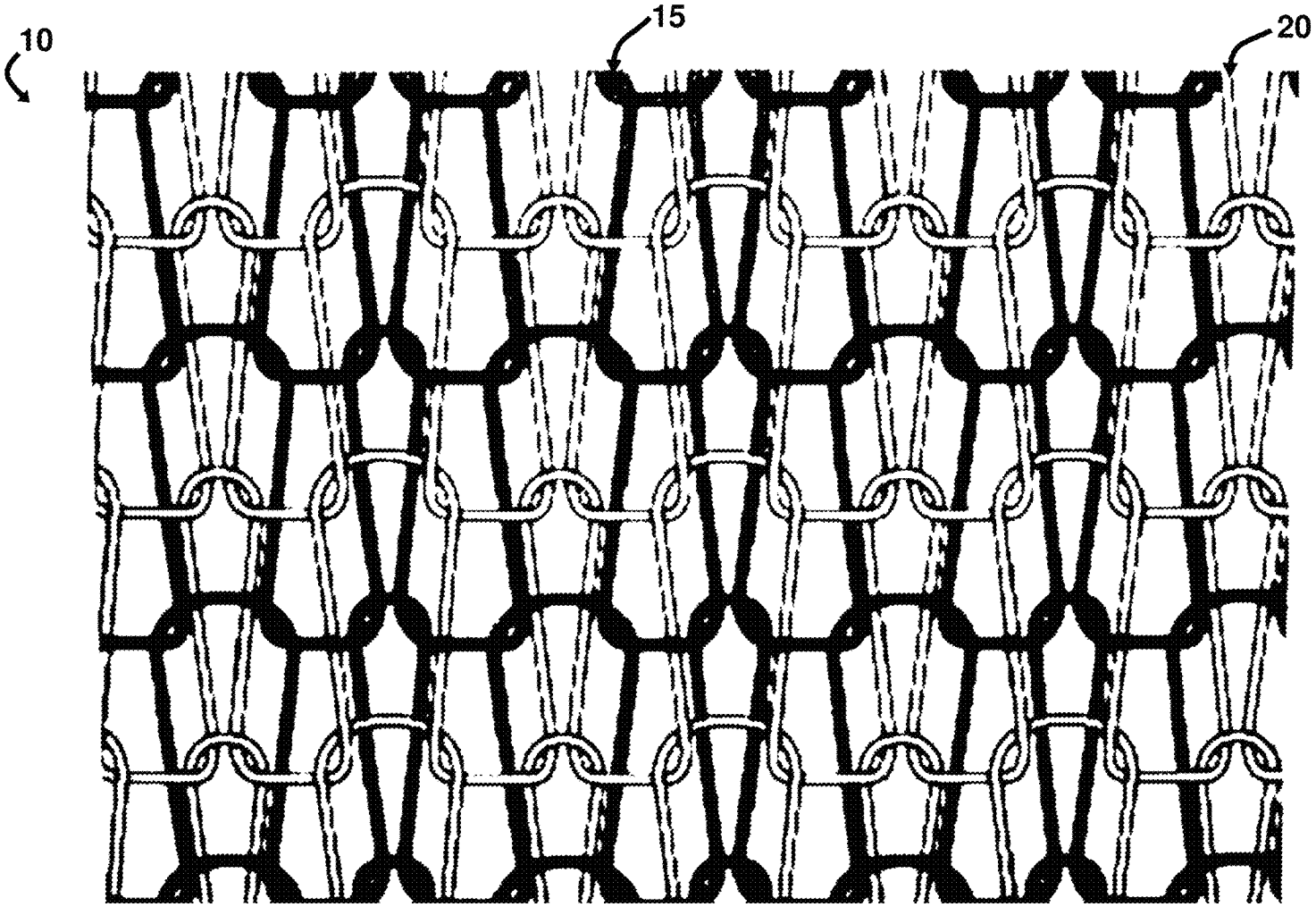
FIG. 1C is a schematic diagram illustrating a UV-protective fabric in an interlock configuration, according to an embodiment herein.

The fabric 10 comprises a warp yarn 15 and a weft yarn 20. Moreover, the fabric 10 comprises a material composition comprising 89% polyester and 11% spandex. FIGS. 1A through 1C illustrate three example pattern arrangements for the warp yarn 15 and the weft yarn 20 of the fabric 10. For ease of illustration, the arrows and element numbers are provided for only one of each of the warp yarns 15 and the weft yarns 20. However, those skilled in the art would understand that this is for ease of illustration and not limitation of the drawings. The warp yarn 15 may be configured as the longitudinal yarns in the fabric 10, and in manufacturing the fabric 10, a matrix of the warp yarn 15 may be stretched and held in tension while the weft yarn 20 (i.e., fill yarn) is inserted or filled through the matrix of the warp yarn 15 in an over-under arrangement such that the weft yarn 20 is transverse to the warp yarn 15. Moreover, the weave arrangement of the warp yarn 15 and the weft yarn 20 may comprise any suitable configuration including a cross, interlock, rib, two face, sport, single knit, double knit, mattress, jacquard, blister, relief, Swiss Double Pique, French Double Pique, Dutch Double Pique, Milano, rib, tuck filet, rib filet, or a combination thereof. Preferably according to the embodiments herein, the fabric 10 is arranged in either a double knit or interlock configuration as these configurations provide a softer texture and feel to the fabric 10, which provides for enhanced wearer comfort. In a preferred embodiment, the fabric 10 is arranged in a double knit configuration.

The thickness and width of each yarn of the warp yarn 15 and weft yarn 20 may be selected for a particular application of the fabric 10. The warp yarn 15 may be thinner/finer than the weft yarn 20, according to an example. In another embodiment, the warp yarn 15 and the weft yarn 20 may comprise substantially the same thickness and width. Moreover, the fabric 10 may we weaved in any suitable pattern. In an example, the fabric 10 is arranged in a plain weave. In another example, the fabric 10 may be arranged in a double warp configuration such that there are two or more sets of warp yarn 15 and one or more sets of weft yarn 15 interconnected to form the fabric 10. In an embodiment, the fabric 10 comprises a woven fabric 10 with spandex warp yarns 15 and Tencel® weft yarns 20. In an alternative embodiment, the fabric 10 comprises a woven fabric 10 with Tencel® warp yarns 15 and spandex weft yarns 20.

In an embodiment, the fabric 10 comprises a woven fabric 10 comprising a yarn size of approximately 30d to 112.1d. The fabric 10 has total thread count of approximately 43 wales per inch/72 courses per inch. Moreover, the fabric 10 may have a weight of approximately 5.52 oz/sq yd. The fabric 10 may have an air permeability of 69.2 $ft^3/ft^2$ min avg. Furthermore, the fabric 10 may have a water vapor transmission of approximately 778 g/sq. m per 24 hours.

The fabric or thread count is defined as the number of yarns present per unit area. If a textile has a high enough fabric count relative to the yarn size, it can be qualified as having a very dense or 'jammed' structure that prevents light from transmitting to the user's skin. In terms of structure, the fabric 10 can be measured on its cover factors of yarns in both the warp and weft direction. For woven fabrics, the warp represents the longitudinal stationary yarns while the weft are the yarns that transverse the warp wrapped under and over these yarns. These yarns are interlaced. For knit textiles, warp knitting refers to knitting where each horizontal loop is made with a different thread. These yarns are interloped and tend to create coarse textiles. Weft knitting refers to knitting whereby the horizontal loops are made with one thread across the length of the fabric. This type of knitting tends to create thin textiles.

The fabric 10 may be either a weave or knit construction. An exemplary construction for the fabric 10 is a knit construction consistent throughout with interlacings to permit a tighter construction. Moreover, a higher weft cover factor increases the UPF. Hence, lower amounts of interlacings lead to better sun protection for the user. Furthermore, the construction of the fabric 10 is specifically tailored to prevent loosening of the weave or knit that would result in undesired UV penetration through the fabric 10. As such, the fabric 10 is suitably configured to ensure a UPF rating of at least 49 in accordance with AATCC 183, according to an embodiment herein.

According to an example, at least one of the warp yarn 15 and the weft yarn 20 is an elastane yarn, which may comprise natural and/or synthetic fibers creating stretch and recovery for the yarn and thus yielding a generally stretchy or forgiving fabric 10. The elastane yarn is made of polyurethane and polyethylene glycol. In an example, the elastane yarn may comprise a denier ranging from 15d to 60d, preferably, ranging from 20d to 40d.

In an example, the elastane yarn may be spandex such as Lycra® material. The content of the elastane in the fabric 10 may be 10% to 40% by weight of the overall fabric 10, according to an example. Additionally, the elastane may aid in achieving a desired tightness in the fabric 10, and consequently may aid in reducing porosity (and increasing cover factor) of the fabric 10, thereby affording better UV protection of the fabric 10. The combination of the warp yarn 15 and the weft yarn 20 is arranged to form the fabric 10 comprises an UPF rating of at least 49 in accordance with AATCC 183. In another example, the fabric 10 comprises an UPF rating of at least 50 in accordance with AATCC 183. Moreover, the UPF rating is achieved without applying laundry additives to the fabric 10.

Table 1 below provides some example UPF ratings and the corresponding percentage of UV that is blocked for the given UPF rating. The fabric 10 corresponds with an excellent UV protection factor. Moreover, for the fabric 10, it is the construction pattern that demonstrates a percentage of UV blockage that is deemed excellent for UPF ratings placing it at greater than 98% blockage of both UVA rays and UVB rays, according to an example.

TABLE 1

UPF ratings and % UV Blocked

| UV Qualitative Protection Desired | UPF Rating Ranges | Blocked UV (%) |
|---|---|---|
| Average-Good | 15-24 | 93.3%-95.8% |
| Good-Very Good | 25-39 | 96.0%-97.4% |
| Very Good-Excellent | 40-above | 97.5%-98.0% |

In an example, at least one of the warp yarn 15 and the weft yarn 20 may be selected from a synthetic yarn and a semi-synthetic yarn. The warp yarn 15 may be a synthetic yarn and the weft yarn 20 may be a semi-synthetic yarn. Alternatively, the warp yarn 15 may be a semi-synthetic yarn and the weft yarn 20 may be a synthetic yarn. Still alternatively, the warp yarn 15 and weft yarn 20 may both be a synthetic yarn. Yet still alternatively, the warp yarn 15 and the weft yarn 20 may both be a semi-synthetic yarn. As used herein, a synthetic yarn may be artificially manufactured exclusively through chemical synthesis (i.e., manmade) and without containing any natural fibers (i.e., the synthetic yarn contains non-animal and non-plant fibers). Moreover, as used herein, a semi-synthetic yarn may contain natural raw materials that are modified through chemical processes.

In an example, the synthetic yarn may comprise a polyester yarn. Moreover, the polyester yarn may comprise a recycled polyester yarn, which may aid in blocking UV radiations, while also aiding in maintaining the lightweight and moisture wicking properties of the fabric 10. In an example, the polyester yarn may comprise a polyethylene terephthalate (PET) yarn. According to an embodiment, the synthetic yarn may comprise 30d spandex at 128"×1 rev (3.7 cms on 30 needles). In an example, the semi-synthetic yarn may be composed of cellulose regenerated fibers. In another example, the semi-synthetic yarn may comprise rayon. In still another example, the semi-synthetic yarn may comprise lyocell.

According to an example, the fabric 10 may have a cover factor ranging from 60% to 85% after 40 laundering cycles in accordance with AATCC 135 2018. The UPF rating of fabric 10 may be determined in accordance with AATCC 183-2010. Additionally, the fabric 10 may have an UPF rating of at least 49 in accordance with AATCC 183. Moreover, the UPF rating may be determined in accordance with AATCC 183-2010 after 40 laundering cycles and further in accordance with AATCC 135 2018. The fabric 10 may comprise 36/1 Tencel® Murata Vortex Spinner (MVS) at 298"×1 rev (8.6 cm on 30 needles), according to an example. In an embodiment, the fabric 10 may further comprise a bleaching agent. In some examples, the bleaching agent may comprise sodium hypochlorite, bleaching powder, sodium chlorite, hydrogen peroxide, sodium persulphate, sodium percarbonate, sodium perborate, peracetic acid, sodium dithionite or sodium hydrosulfite, sodium thiosulphate, sulfinic acid, or a combination thereof.

According to some examples, the fabric 10 may be devoid of bleached chemical thermo mechanical pulp, textile fleece, activated carbon, magnesium stearate, a disintegrant, or zinc oxide. In other examples, the fabric 10 may be devoid of titanium finishes or coatings. As such, the fabric 10 does not require ultraviolet protecting coating(s) or finish(es) or such other treatment for achieving the desired ultraviolet protecting efficiency provided by the embodiments herein. In general, conventional sun protective clothing that utilizes titanium finishes for UV protection can actually be fire retardant as well. This is not the case for the fabric 10 as these finishes and coatings are not used.

Figure 2:
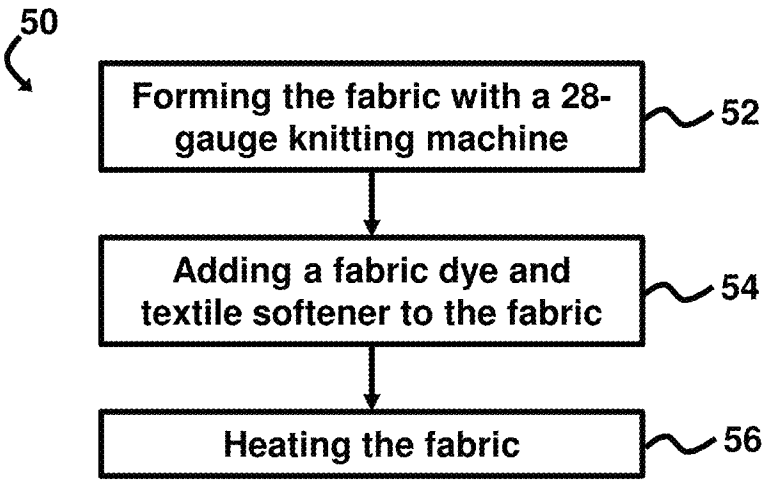
FIG. 2 is a flow diagram illustrating a process for fabricating the UV-protective fabric of FIGS. 1A through 1C, according to an embodiment herein.

FIG. 2, with reference to FIGS. 1A through 1C, is a flow diagram illustrating a process 50 for forming the fabric 10. The process 50 comprises forming (52) the fabric 10 with a 28-gauge knitting machine, which creates the weave of the warp yarn 15 and weft yarn 20. The fabric 10 comprises a material composition of 89% polyester and 11% spandex by mass of the overall fabric 10, which is not only a preferred composition ratio, but the optimal composition in order to achieve the desired UPF rating of at least 49. As indicated in the experimental results below, the composition ratio provided by the embodiments herein achieves unexpected results with respect to the stretch properties as well as the UPF rating. An example of a suitable 28-gauge knitting machine used in accordance with the embodiments herein may be the M-LEC6DSI available from Monarch Knitting Machinery Corp. (Monroe, NC, USA). The selection of a 28-gauge knitting machine may correspond with an exemplary thread count between 30-32 Ne.

The process 50 may comprise adding (54) a fabric dye and textile softener to the fabric 10. In some examples, the fabric dye may comprise a fiber reactive dye, an acid dye, a union dye, a direct dye, a disperse dye, or a combination thereof. In an example, the textile softener may comprise a cationic softener or an anionic softener. The process 50 may comprise heating (56) the fabric 10 between approximately 110° C. to 200° C. for approximately 6-10 hours. The constructed fabric 10 achieves enhanced strength capabilities that help resist the fabric 10 from being worn out after use and washing. In this regard, the addition of elastane, according to an exemplary embodiment, helps the fabric 10 retain its minimal porosity and actually increases its cover factor with routine laundering. This also permits the fabric 10 to retain its UPF when wet. Furthermore, the weave process achieves a fabric 10 containing moisture wicking properties, which results in having an antimicrobial effect due to reduced moisture adjacent to a user's skin. Moreover, infrared from the sun causes heat transference to the skin. Accordingly, by blocking infrared rays, the fabric 10 achieves a cooling effect on the user's skin when worn thereby providing for enhanced comfort for a user when wearing the fabric 10 in the sun.

Experiment

The specific parameters, values, amounts, ranges, materials, types, brands, etc. described below are approximates and are merely selected for the experiments, and as such the embodiments herein are not limited to the specific descriptions below.

A Quality Assurance and Compliance Test was performed by Vartest® Laboratories, of New York, NY (USA). In the test, the fabric 10 comprised 89% polyester/11% spandex, with a double knit weave pattern, and was white in color. The tested fabric 10 was 36/1 polyester at 298"×1 rev (8.6 cm on 30 needles) and the spandex was 30 denier at 198"×1 rev (3.7 cm on 30 needles). Table 2 below provides the description of the test procedures and the corresponding test results.

TABLE 2

| Test procedures and results | |
|---|---|
| Test Procedures | Test Results |
| Fabric Weight (ASTM D3776) | 5.52 oz/sq yard<br>187 g/sq meter |
| Fabric Count (ASTM D3775) | 43 wales/inch × 72 courses/inch |
| Yarn Size (ASTM D1059) without spandex | ~112.1/denier |
| Yarn Size (ASTM D1059) with spandex | 30 denier (3 filaments) |
| Air Permeability | 69.2 $ft^3/ft^2 \cdot$ min average |
| Water Vapor Transmission (ASTM E96)-Procedure B, Water Method, 73.4° F. 50% RH: Air Gap ¾ inch: | Specimen 1: 790 g/sq meter/24 hours<br>Specimen 2: 773 g/sq meter/24 hours |
| Transmission Rate: (Specimens 1 through 3) | Specimen 3: 770 g/sq meter/24 hours<br>Average: 778 g/sq meter/24 hours |

Table 3 below provides test results related to the stretch properties of the tested fabric 10.

TABLE 3

| Tested stretch properties | | |
|---|---|---|
| Stretch Properties of Knitted Fabric (ASTM D2594) Growth (2 hr ± 5 min) | Wale | Course |
| After 2 hours, 15% extension in wale direction and 30% extension in course direction: | | |
| 60 ± 5 secs. after releasing: | 2.7% avg. | 0.1% avg. |
| 1 hr ± 5 min. after releasing: | 0.0% avg. | 0.0% avg. |
| Stretch | 80.3% | 89.7% |
| After manually exercising the specimen 4 times with a 5 pound load, initiate a $5^{th}$ cycle, hold the load for 5-10 seconds | | |
| Recovery | | |
| After extension and releasing: | | |
| 60 ± 5 secs. after releasing | 82.2% avg. | 99.8% avg. |
| 1 hr. ± 5 min. after releasing | 100% avg. | 100% avg. |

Table 4 below provides test results related to the UV blocking properties of the tested fabric 10.

TABLE 4

| Tested UV blocking properties | | | | | |
|---|---|---|---|---|---|
| Transmittance or blocking of erythemally weighted ultraviolet radiation through fabrics (AATCC 183) Single layer of fabric | | | | | |
| Wavelength Range: 290-400 nm | | | | % UV Blocking | |
| Units | UPF | T (UVA) | T (UVB) | (UVA) | (UVB) |
| Number of Scans | 12 | 12 | 12 | | |
| Mean | 500.00% | 0.17% | 0.13% | 99.83% | 99.87% |
| STD | 0.00% | 0.01% | 0.02% | | |
| UPF Rating: | | | 50+ | | |

A challenge in constructing the fabric 10 is determining the precise percentage of elastane (i.e., spandex) that is used to adequately achieve sun protection without compromising the wearability of the fabric 10. For example, adding too much or too little spandex to the overall composition of the fabric 10 significantly impacts the delicate balance of UV protection versus the actual breathability or wearability of the fabric 10. Accordingly, it was experimentally determined that the 89% polyester/11% spandex blend for the fabric 10 achieved the desired UV protection as well as the desired breathability and wearability of the fabric 10.

Generally, the experimental testing demonstrated the ability of the fabric 10 to substantially recover due to movement and gradual wear. Indeed, some of the test results yield surprising and unexpected results such as the 100% average wale and course stretch (after extension and releasing) properties after approximately one hour, which typically fall below a 100% threshold for fabrics that have at least a 50+ UPF rating without UV chemical finishes. Prior to testing, it was expected that the stretch properties would be far less than 100% or that the UPF rating would be less than the 50+ UPF rating that was achieved. Accordingly, the UPF characteristics in combination with the stretch properties demonstrate improved and unexpected results of the fabric 10 compared to comparable industry results. Moreover, when compared to the qualitative UV protection guideline provided in Table 1, the experimental tested fabric 10 achieves much better UV block percentages both for UVA and UVB than even an "excellent" standard as provided in Table 1. Additionally, as mentioned above, the color of the test fabric was white, which is significant because the color white in textiles is least likely to demonstrate good UPF protection. However, as noted by the test results, even the white colored test fabric was demonstrated to retain a UPF of 50+, which was a surprising and unexpected result that was achieved.

To summarize the results provided in Tables 2 through 4, the fabric 10 achieved a UPF Test of 50+ with 99.83% UVA and 99.87% UVB blockage. The fabric weight was tested in accordance with ASTM D3776) and was determined to be 5.52 oz/sq yd. (187 g/sq meter). The fabric count was tested in accordance with ASTM D3775 to determine the yarns per inch in the warp and filling (weft) directions of the fabric 10 and was determined to be 43 wales per inch/72 courses per inch (knit fabric). This test indicates whether the fabric 10 is coarse or fine and is an indicator of fabric durability. A higher thread count lends to a more durable textile with less likelihood of yarn shifting. This is important for a sun-protective textile without a UV chemical finish to ensure its ability to retain UV protective capacity through routine wear and laundering.

Wales are the number of vertical columns measured per inch, and courses are the total number of horizontal rows measured per inch. The course is a horizontal row of loops formed by all the adjacent needles during one revolution. The course length is obtained by multiplying the loop length with the number of needles involved in the production of the course. The test results demonstrate a generally durable fabric 10 with less likelihood of yarn shifting (which is further indicated in the magnified images of the fabric 10 shown in FIGS. 3D through 3F).

The yarn size was tested in accordance with ASTM D1059 and was determined to be 112.1 denier (without spandex), and 30 denier (with spandex). This test method is adequate for estimating the approximate yarn number of the yarn used to weave or knit the fabric 10. The air permeability was tested in accordance with ASTM D737 and was determined to be 69.2 $ft^3/ft^2 \cdot$min avg. This test method covers the measurement of the air permeability; i.e., the rate of airflow passing perpendicularly through a known area under a prescribed air pressure differential between the two surfaces of a material. The higher the air permeability rate, the faster the heat loss obtained from a textile material. For summer wear or sportswear, a modal pique structure could be used as it is characterized by higher air permeability, creating a cool feeling to the wearer by allowing more cold air to penetrate therethrough to bring the heat away from the body and accelerate the sweat evaporation at the skin and fabric surface. For textiles to be worn in the sun, air permeability and cooling are essential for wearability. As such, air permeability refers to how well air can pass through a material. Air permeability can be measured, whereas breathability is subjective. Accordingly, increased air permeability generally means increased breathability of the fabric 10. The test results demonstrate above average air permeability characteristics of the fabric 10.

The water vapor transmission was tested in accordance with ASTM E96 and was determined to be 778 g/sq m per 24 hours. The fabric water vapor resistance increases with the increasing weight of the fabric 10. As a result, it can be difficult to release sweat (i.e., wicking) from the body in the form of water vapor, as the water vapor resistance is high. For this reason, the fabrics used in sports wear such as fabric 10 must have low water vapor resistance values. The experimental tests show that the increased water vapor transmission of three specimens of fabric 10 resulted in high fabric breathability. During periods of high activity that cause increased sweating, the increased permeability of the water vapor provides better comfort for a wearer of the fabric 10.

Figure 3A:
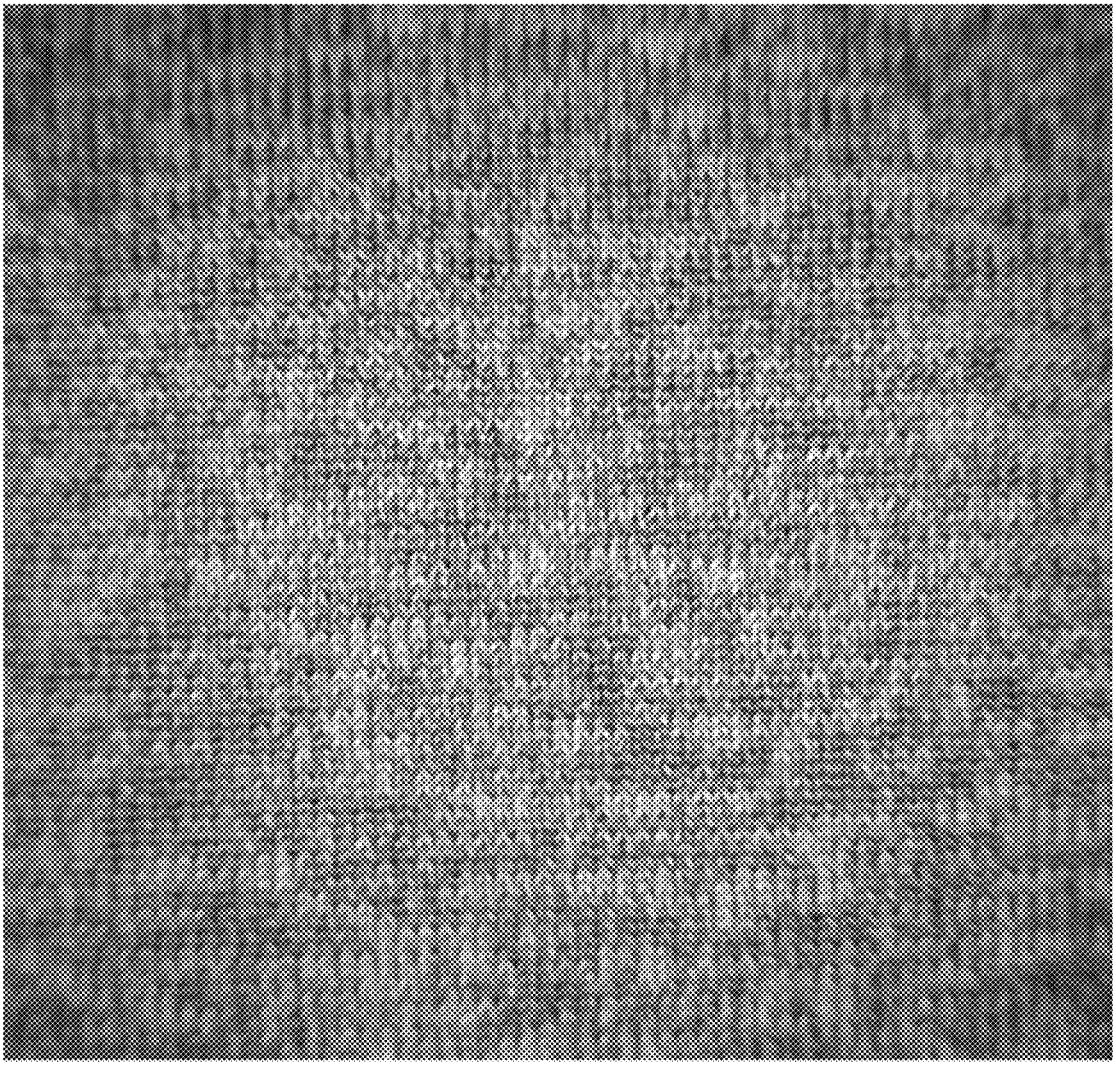
FIG. 3A is a magnified image (20× magnification) of a grey-colored UV-protective fabric, according to an embodiment herein.
Figure 3B:
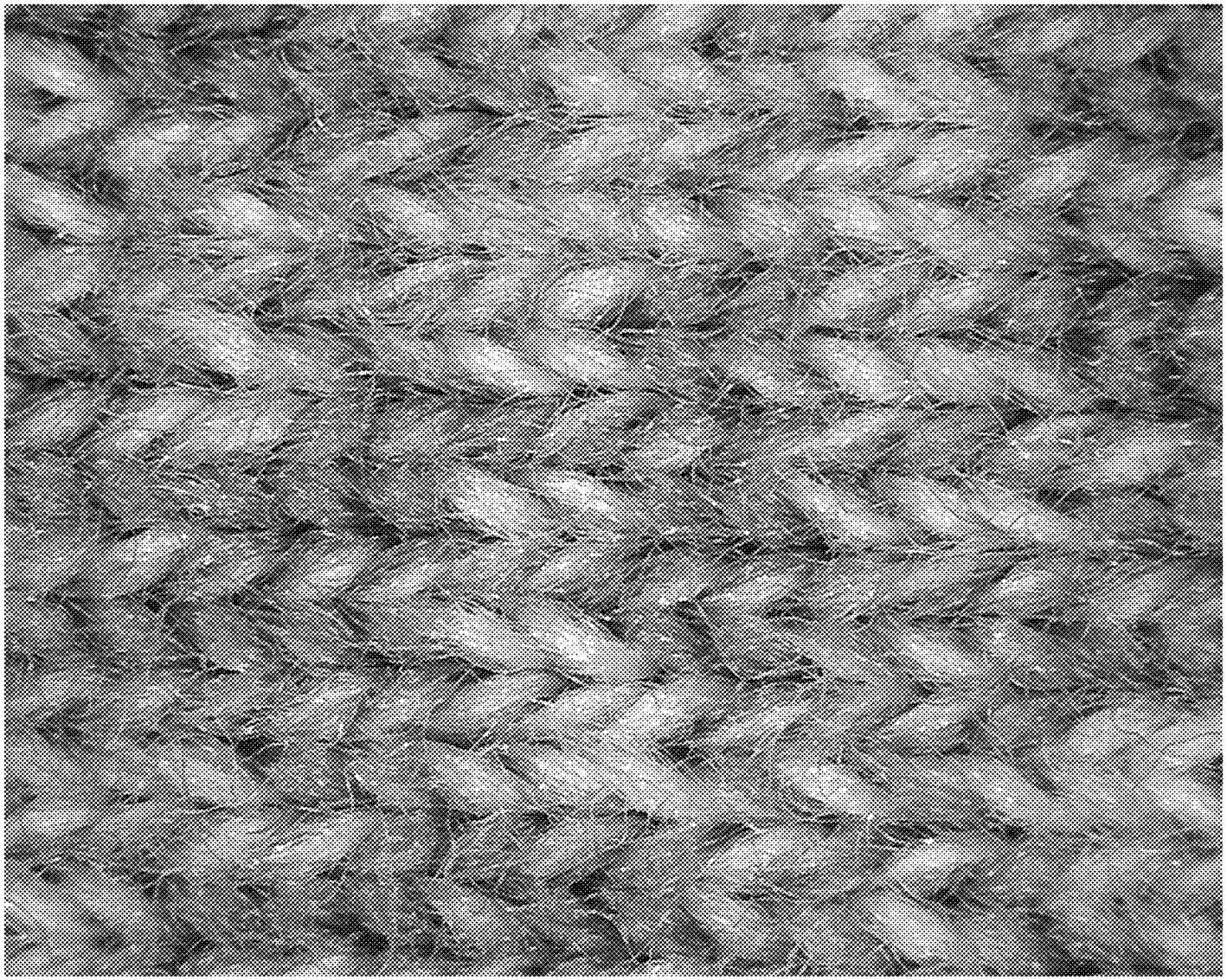
FIG. 3B is a magnified image (50× magnification) of a grey-colored UV-protective fabric, according to an embodiment herein.
Figure 3C:
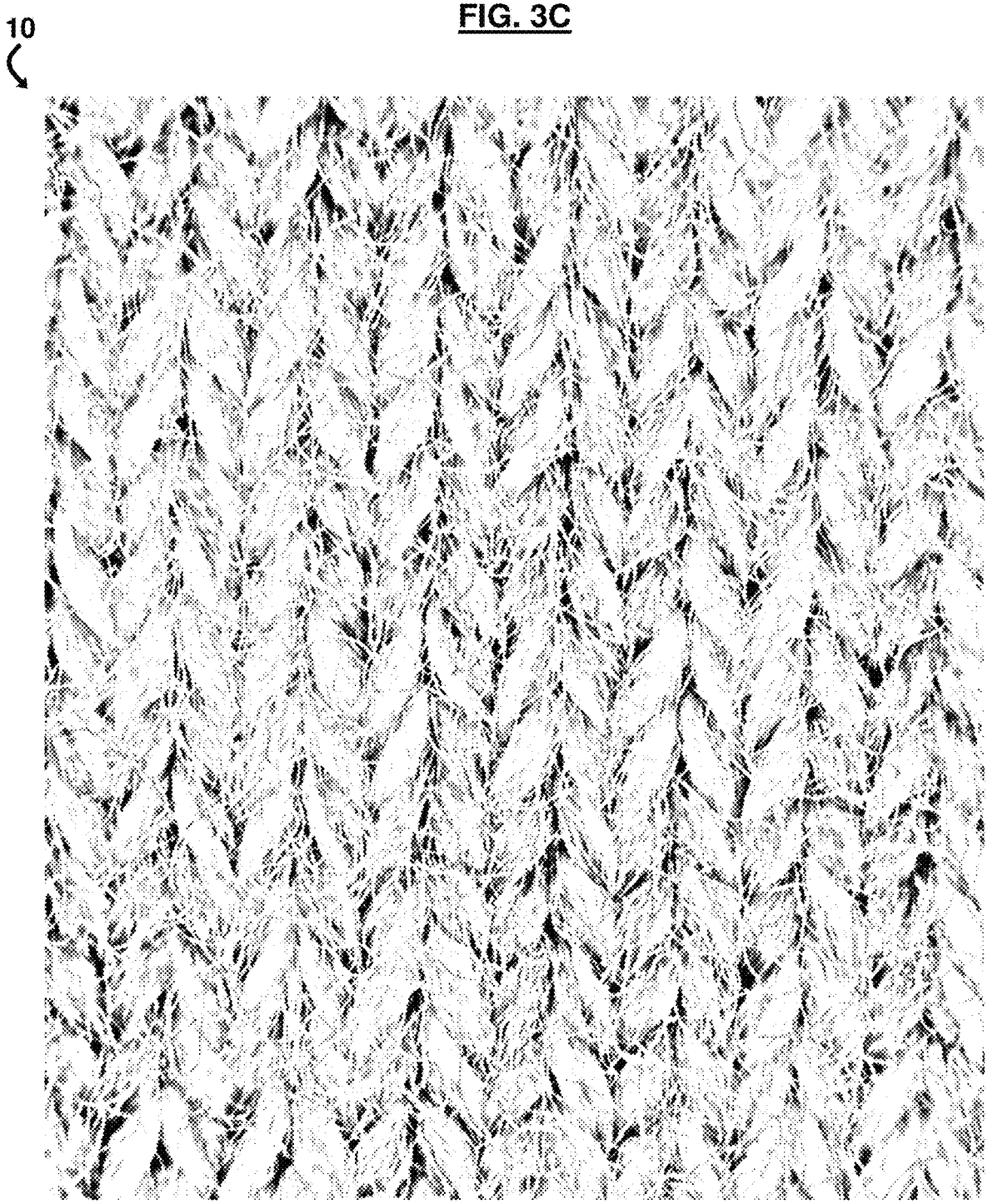
FIG. 3C is a schematic diagram of the image of FIG. 3B, according to an embodiment herein.
Figure 3D:
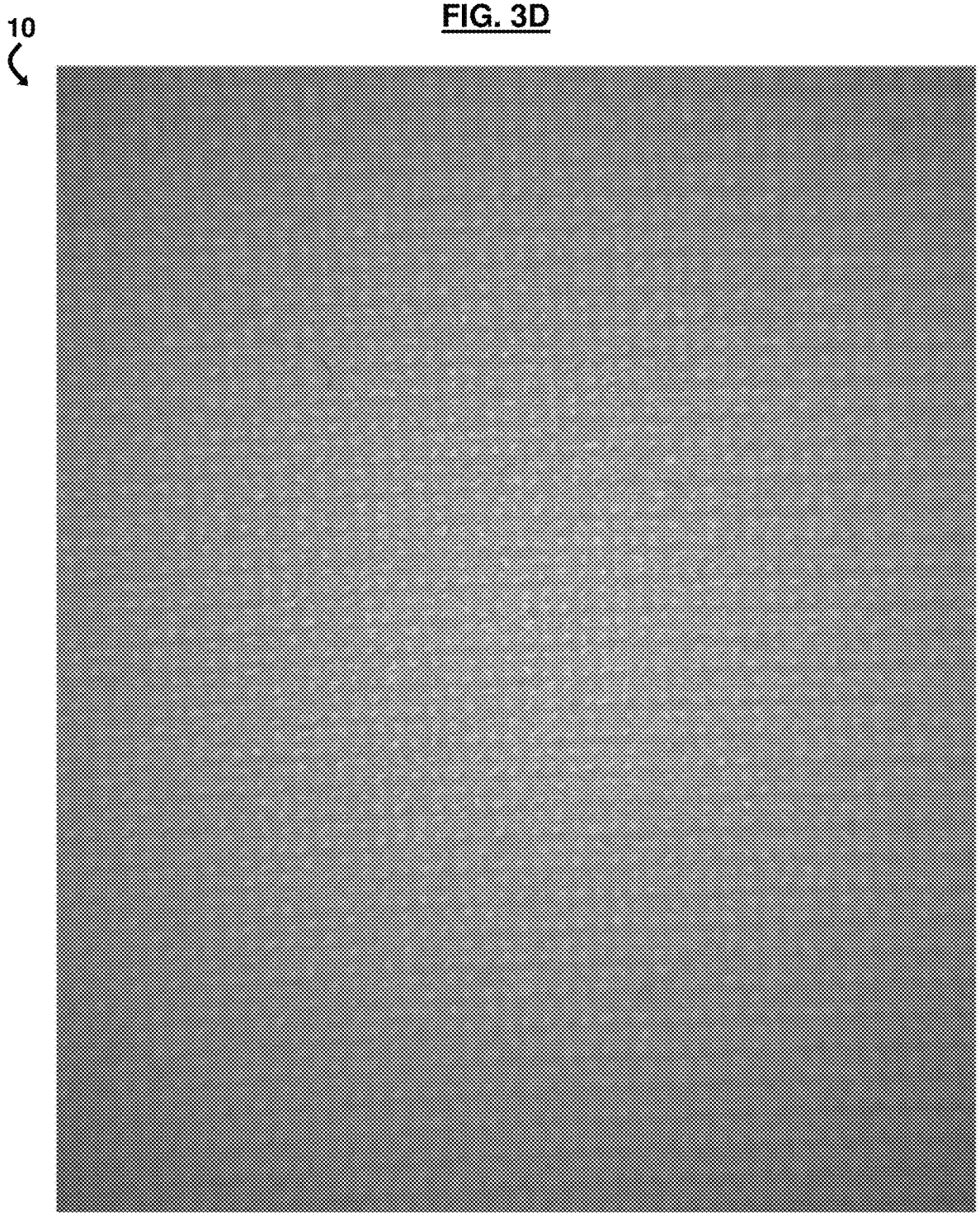
FIG. 3D is a magnified image (20× magnification) of a white-colored UV-protective fabric, according to an embodiment herein.
Figure 3E:
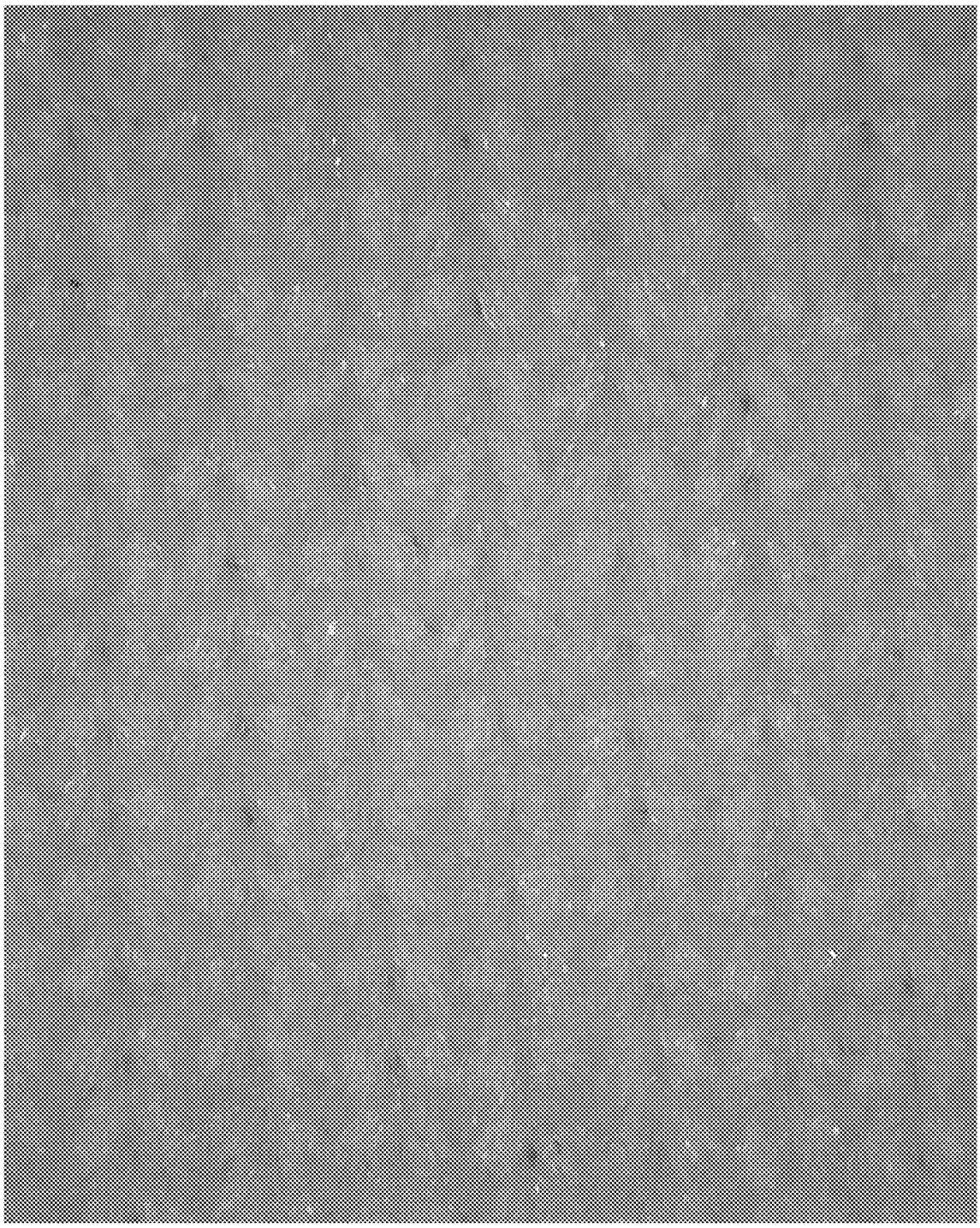
FIG. 3E is a magnified image (50× magnification) of a white-colored UV-protective fabric, according to an embodiment herein.
Figure 3F:
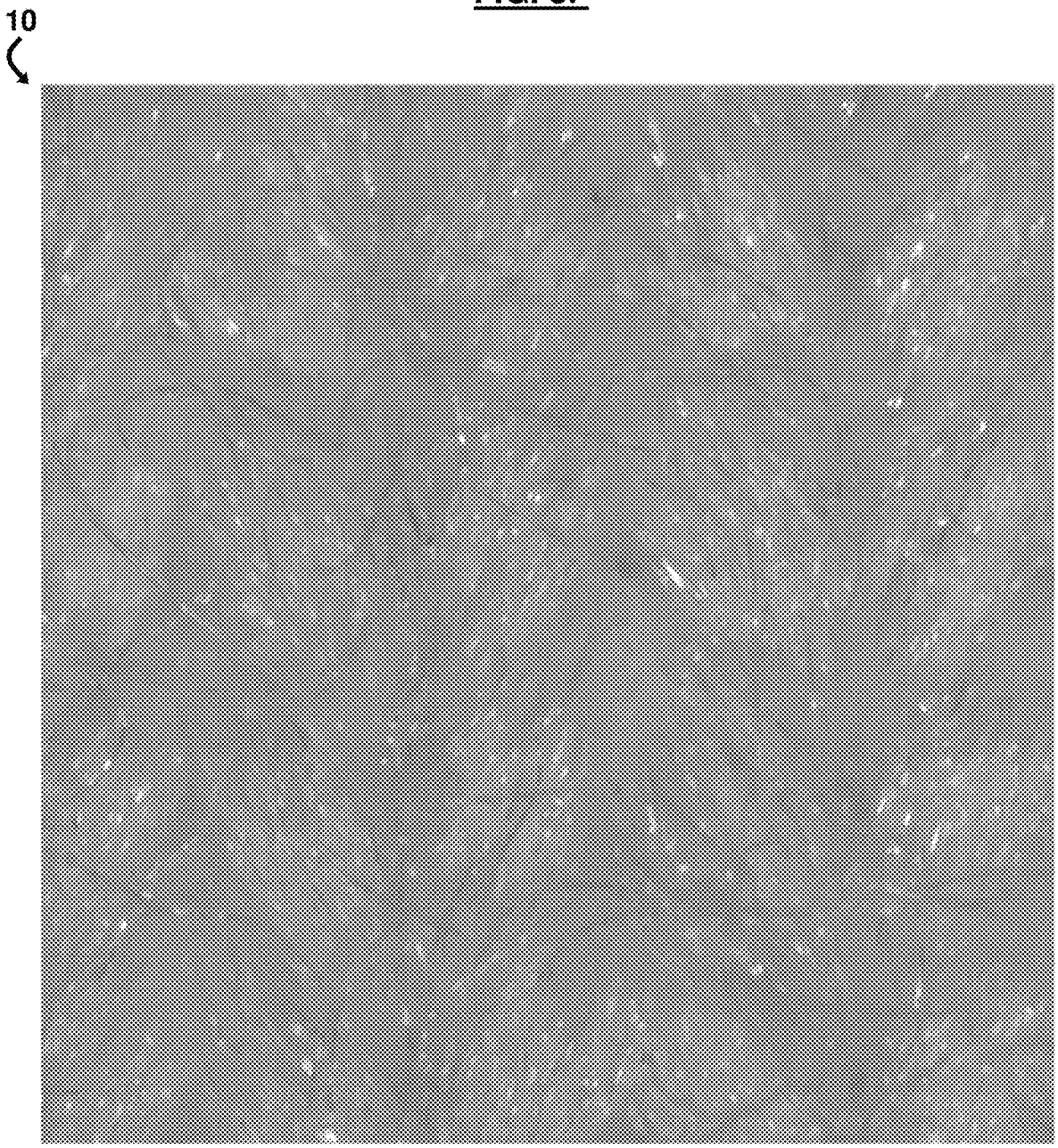
FIG. 3F is a magnified image (225× magnification) of a white-colored UV-protective fabric, according to an embodiment herein.

FIGS. 3A and 3B are magnified photographic images of a grey-colored fabric 10 at 20χ and 50× magnification, respectively. FIG. 3C is a schematic diagram of the image of FIG. 3B. FIGS. 3D through 3F are magnified photographic images of a white-colored fabric 10 at 20x, 50x, and 225× magnification, respectively. In FIGS. 3A through 3F, the fabric 10 is shown in a double knit construction in accordance with a preferred embodiment herein. Indeed, selecting a specific weave pattern for the fabric 10 is challenging because there is always a trade-off in the weave pattern impacting UPF (i.e., a particular weave pattern can cause variability in UPF results, which is not preferred for a quality assurance perspective).

One way of overcoming this challenge is by selecting a specific blend of materials for the fabric 10. In an example, the fabric 10 is provided consisting essentially of 89% polyester/11% spandex by mass of the overall material composition of the fabric 10, which is the preferred material composition in order to achieve an UPF rating of at least 49. Another way of overcoming this challenge is improving the actual quality of construction, which can overcome the variable UPF results irrespective of the specific weave pattern that is selected. For example, utilizing higher quality yarns, weave equipment, and utilizing stricter post-manufacturing quality assurance guidelines and testing methods can ensure more cohesion in the UPF that is ultimately achieved by the fabric 10.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. An ultraviolet blocking fabric to be worn by a user, the fabric comprising:

a warp yarn comprising a recycled polyester yarn; and a weft yarn comprising a spandex yarn, wherein the fabric comprises a material composition of 89% of the recycled polyester yarn and 11% of the spandex yarn by mass of the fabric as the fabric is first formed, wherein the A spandex yarn comprises spandex with a denier ranging from 15d to 60d, wherein a combination of the warp yarn and the weft yarn are arranged to form the fabric having an ultraviolet protection factor (UPF) rating of at least 49 in accordance with AATCC 183-2010, wherein the fabric achieves the UPF rating of at least 49 while the fabric is devoid of any ultraviolet protecting coating and of any laundry additives, wherein the fabric has a cover factor ranging from 70% to 85% after 40 laundering cycles in accordance with AATCC 135 2018, and wherein the fabric comprises:

a yarn size of approximately 30d to 112.1d:

a fabric count of approximately 43 wales/inch×72 courses/inch:

a fabric weight of approximately 5.52 oz/sq yd;

an air permeability of approximately 69.2 $ft^3/ft^2 \cdot min$; and a water vapor transmission of approximately 778 g/sq. m per 24 hours.

2. The fabric of claim 1, wherein the fabric has an ultraviolet protection factor (UPF) rating of at least 50 in accordance with AATCC 183-2010.

3. The fabric of claim 1, wherein the ultraviolet protection factor (UPF) rating is determined in accordance with AATCC 183-2010 after 40 laundering cycles and further in accordance with AATCC 135 2018.

4. The fabric of claim 1, wherein the fabric is devoid of bleached chemical thermo mechanical pulp, textile fleece, activated carbon, magnesium stearate, a disintegrant, or zinc oxide.

5. The fabric of claim 1, wherein the warp yarn comprises yarn without spandex, wherein the spandex yarn has a yarn size in the range of approximately 15d to approximately 60d, and wherein the warp yarn has a yarn size of approximately 112.1d.

6. A process for forming the fabric of claim 1, comprising forming the fabric with a 28-gauge knitting machine.

7. The process of claim 6, comprising adding a fabric dye and textile softener to the fabric.

8. The process of claim 7, comprising heating the fabric.

9. The fabric of claim 1, wherein the fabric comprises a double knit configuration.

10. The fabric of claim 1, wherein the fabric comprises a single knit configuration.

11. The fabric of claim 1, wherein the warp yarn is thinner and finer than the weft yarn.

12. The process of claim 7, wherein the fabric dye comprises a fiber reactive dye, an acid dye, a union dye, a direct dye, a disperse dye, or a combination thereof.

13. The process of claim 7, wherein the textile softener comprises a cationic softener.

14. The process of claim 7, wherein the textile softener comprises an anionic softener.

15. The process of claim 8, wherein heating the fabric comprises heating the fabric at a temperature between 110° C. to 200° C.

16. The process of claim 8, wherein heating the fabric comprises heating the fabric for a duration of 6 to 10 hours.

17. The process of claim 6, further comprising knitting the warp yarn and the weft yarn together in a weave pattern selected from the group consisting of a cross, interlock, rib, two face, sport, single knit, double knit, mattress, jacquard, blister, relief, Swiss Double Pique, French Double Pique, Dutch Double Pique, Milano, tuck filet, rib filet, or a combination thereof.

18. A process for forming the fabric of claim 1, comprising forming the fabric with a knitting machine.

19. The process of claim 18, comprising adding a fabric dye and textile softener to the fabric.

* * * * *